US005731119A

United States Patent [19]

Eichorst et al.

[11] Patent Number: 5,731,119

[45] **Date of Patent: *Mar. 24, 1998**

[54] IMAGING ELEMENT COMPRISING AN ELECTRICALLY CONDUCTIVE LAYER CONTAINING ACICULAR METAL OXIDE PARTICLES AND A TRANSPARENT MAGNETIC RECORDING LAYER

[75] Inventors: Dennis J. Eichorst, Fairport; Paul A. Christian, Pittsford; Gerald M. Leszyk, Spencerport, all of N.Y.

[73] Assignee: Eastman Kodak Company, Rochester, N.Y.

[ * ] Notice: The term of this patent shall not extend beyond the expiration date of Pat. No. 5,719,016.

[21] Appl. No.: 747,480

[22] Filed: Nov. 12, 1996

[51] Int. Cl.[6] ..... G03C 1/85; G03C 1/86; G03G 5/10

[52] U.S. Cl. ..... 430/63; 430/53; 430/69; 430/201; 430/527; 430/529; 430/530

[58] Field of Search ..... 430/63, 69, 527, 430/529, 201, 53, 530

[56] References Cited

U.S. PATENT DOCUMENTS

| | | | |
|---|---|---|---|
| 3,782,947 | 1/1974 | Krall . | |
| 4,279,945 | 7/1981 | Audran et al. | 430/271 |
| 4,302,523 | 11/1981 | Audran et al. | 430/140 |
| 5,147,768 | 9/1992 | Sakakibara | 430/501 |
| 5,217,804 | 6/1993 | James et al. | 428/329 |
| 5,229,259 | 7/1993 | Yokota | 430/523 |
| 5,294,525 | 3/1994 | Yamauchi et al. | 430/530 |
| 5,336,589 | 8/1994 | Mukunoki et al. | 430/501 |
| 5,382,494 | 1/1995 | Kudo et al. | 430/530 |
| 5,395,743 | 3/1995 | Brick et al. | 430/496 |
| 5,413,900 | 5/1995 | Yokota et al. | 430/495 |
| 5,427,900 | 6/1995 | James et al. | 430/496 |
| 5,457,013 | 10/1995 | Christian et al. | 430/496 |
| 5,459,021 | 10/1995 | Ito et al. | 430/527 |
| 5,484,694 | 1/1996 | Lelental et al. | 430/530 |
| 5,498,512 | 3/1996 | James et al. | 430/496 |

FOREIGN PATENT DOCUMENTS

| | | |
|---|---|---|
| 04-062543 | 2/1992 | Japan . |
| 06-161033 | 11/1992 | Japan . |
| 07-159912 | 6/1995 | Japan . |
| 07-168293 | 7/1995 | Japan . |

*Primary Examiner*—Richard L. Schilling
*Attorney, Agent, or Firm*—Carl F. Ruoff

[57] ABSTRACT

The present invention describes an imaging element which includes a support, an image-forming layer, a transparent magnetic recording layer, and an electrically-conductive layer. The electrically-conductive layer is a dispersion in a film-forming binder of acicular, crystalline single phase, semi-conductive metal-containing particles having a cross-sectional diameter less than 0.02 μm and an aspect ratio of greater than or equal to 5:1.

37 Claims, No Drawings

IMAGING ELEMENT COMPRISING AN ELECTRICALLY CONDUCTIVE LAYER CONTAINING ACICULAR METAL OXIDE PARTICLES AND A TRANSPARENT MAGNETIC RECORDING LAYER

CROSS-REFERENCE TO RELATED APPLICATIONS

This application relates to commonly assigned copending application Ser. No. 05/746,618, Express Mail No. EM109034106 US which is filed simultaneously herewith and hereby incorporated by reference for all that it discloses.

1. Field of the Invention

This invention relates generally to imaging elements comprising a transparent magnetic recording layer including photographic, electrostatographic, photothermographic, migration, electrothermographic, dielectric recording, and thermal-dye-transfer imaging elements, and particularly, to imaging elements comprising a transparent magnetic recording layer in combination with transparent electrically-conductive layers useful for solution-processed silver halide imaging elements.

2. Description of Prior Art

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 5,217,804; 5,229,259; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

A difficulty, however, arises in that magnetic recording layers generally employed by the magnetic recording industry are opaque, not only because of the nature of the magnetic particles, but also because of the requirements that these layers contain other addenda which further influence the optical properties of the layer. Also, the requirements for recording in and reading the magnetic signal from a transparent magnetic layer are more stringent than for conventional magnetic recording media because of the extremely low coverage of magnetic particles required to ensure transparency of the transparent magnetic layer as well as the fundamental nature of the photographic element itself. Further, the presence of the magnetic recording layer cannot interfere with the function of the photographic imaging element.

The transparent magnetic recording layer must be capable of accurate recording and playback of digitally encoded information repeatedly on demand by various devices such as a camera or a photofinishing or printing apparatus. Said layer also must exhibit excellent running, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic layers. These goals are particularly difficult to achieve when magnetically recorded information is stored and read from the photographic image area. Further, because of the curl of the photographic element, primarily due to the photographic layers and the core set of the support, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layers can produce irregular fog patterns or static marks in the emulsion. The severity of these static problems has been exacerbated greatly by the increases in sensitivity of new emulsions, increases in coating machine speeds, and increases in post-coating drying efficiency. The charge generated during the coating process results primarily from the tendency of webs of high dielectric constant polymeric film base to charge during winding and unwinding operations (unwinding static), during transport through the coating machines (transport static), and during post-coating operations such as slitting and spooling. Static charge can also be generated during the use of the finished photographic film product. In an automatic camera, because of the repeated motion of a photographic roll film in and out of the film cassette, especially a small format film comprising a transparent magnetic recording layer, there is the added problem of the generation of electrostatic charge by the movement of the film across magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from electrostatic charging, there are various well-known methods by which a conductive layer can be introduced into the photographic element to dissipate any accumulated charge.

Antistatic layers containing electrically-conductive agents can be applied to one or both sides of the film base as subbing layers either beneath or on the side opposite to the silver halide emulsion layers. An antistatic layer also can be applied as an outer layer coated either over the emulsion layers or on the side opposite to the emulsion layers or on both sides of the film base. For some applications, it may be advantageous to incorporate the antistatic agent directly into the film base or to introduce it into a silver halide emulsion layer. Typically, in photographic elements of prior art comprising a transparent magnetic recording layer, the antistatic layer was preferably present as a backing layer underlying the magnetic recording layer.

The use of such electrically-conductive layers containing suitable semiconductive metal oxide particles dispersed in a film-forming binder in combination with a transparent magnetic recording layer in silver halide imaging elements has been described in the following examples of the prior art. Photographic elements comprising a transparent magnetic recording layer and a transparent electrically-conductive layer both located on the backside of the film base have been described in U.S. Pat. Nos. 5,147,768; 5,229,259; 5,294,525; 5,336,589; 5,382,494; 5,413,900; 5,457,013; 5,459,021; and others. The conductive layers described in these patents comprise fine granular particles of a semi-conductive crystalline metal oxide such as zinc oxide, titania, tin oxide, alumina, indium oxide, silica, complex or compound oxides thereof, and zinc or indium antimonate dispersed in a polymeric binder. Of these conductive metal oxides, antimony-doped tin oxide and zinc antimonate are preferred. A granular antimony-doped tin oxide particle commercially available from ishihara Sangyo Kaisha under the tradename "SN-100P" was disclosed as particularly preferred in Japanese Kokai Nos. 04-062543, 06-161033, and 07-168293.

The preferred average diameter for granular conductive metal oxide particles was disclosed as less than 0.5 μm in U.S. Pat. No. 5,294,525; 0.02 to 0.5 μm in U.S. Pat. No. 5,382,494; 0.01 to 0.1 μm in U.S. Pat. Nos. 5,459,021 and 5,457,013; and 0.01 to 0.05 μm in U.S. Pat. No. 5,457,013. Suitable conductive metal oxide particles exhibit specific volume resistivities of $1\times10^{10}$ ohm-cm or less, preferably $1\times10^{7}$ ohm-cm or less, and more preferably $1\times10^{5}$ ohm-cm or less as taught in U.S. Pat. No. 5,459,021. Another physical property used to characterize crystalline metal oxide particles is the average x-ray crystallite size. The concept of crystallite size is described in detail in U.S. Pat. No. 5,484,694 and references cited therein. Transparent conductive layers containing semiconductive antimony-doped tin oxide granular particles exhibiting a preferred crystallite size of less than 10 nm are taught in U.S. Pat. No. 5,484,694 to be particularly useful for imaging elements. Similarly, photographic elements comprising transparent magnetic layers and antistatic layers containing conductive granular metal oxide particles with average crystallite sizes ranging from 1 to 20 nm, preferably from 1 to 5 nm, and more preferably from 1 to 3.5 nm are claimed in U.S. Pat. No. 5,459,021. Advantages to using metal oxide particles with small crystallite sizes are disclosed in U.S. Pat. Nos. 5,484,694 and 5,459,021 including the ability to be milled to a very small size without significant degradation of electrical performance, ability to produce a specified level of conductivity at lower weight loadings and/or dry coverages, as well as decreased optical denisity, decreased brittleness, and cracking of conductive layers containing such particles.

Conductive layers containing such granular metal oxide particles have been applied at the following preferred ranges of dry weight coverages of metal oxide: 3.5 to 10 g/m$^2$; 0.1 to 10 g/m$^2$; 0.002 to 1 g/m$^2$; 0.05 to 0.4 g/m$^2$ as disclosed in U.S. Pat. Nos. 5,382,494; 5,457,013; 5,459,021; and 5,294,525, respectively. Preferred ranges for the metal oxide fraction in the conductive layer include: 17 to 67 weight percent, 43 to 87.5 weight percent, and 30 to 40 volume percent as disclosed in U.S. Pat. Nos. 5,294,525; 5,382,494; and 5,459,021, respectively. Surface electrical resistivity (SER) values were reported in U.S. Pat. No. 5,382,494 for conductive layers measured prior to overcoating with a transparent magnetic layer as ranging from $10^5$ to $10^7$ ohm/square and from $10^6$ to $10^8$ ohm/square after overcoating. Surface resistivity values of about $10^8$ to $10^{11}$ ohm/square for conductive layers overcoated with a transparent magnetic layer were reported in U.S. Pat. Nos. 5,457,013 and 5,459,021.

In addition to the antistatic layer being present as a backing or subbing layer, the inclusion of conductive tin oxide granular particles with an average diameter less than 0.15 μm in a transparent magnetic recording layer with cellulose acetate binder is disclosed in U.S. Pat. Nos. 5,147,768; 5,427,900 and Japanese Kokai No. 07-159912. For a tin oxide fraction of about 92 weight percent, the surface resistivity of the conductive layer is reported to be approximately $1\times10^{11}$ ohm/square in U.S. Pat. No. 5,427,900.

A silver halide photographic film comprising a conductive backing or subbing layer containing fibrous $TiO_2$ particles surface-coated with a thin layer of conductive antimony-doped $SnO_2$ particles and a transparent magnetic recording layer has been taught in a Comparative Example in U.S. Pat. No. 5,459,021. The average size of said fibrous conductive particles was about 0.2 μm in diameter and 2.9 μm in length. Further, said fibrous particles exhibit a crystallite size of 22.3 nm. Such fibrous conductive particles are commercially available from ishihara Sangyo Kaisha under the tradename "FT-2000". However, conductive layers containing these fibrous particles were disclosed to exhibit fine cracks which resulted in decreased conductivity, increased haze, and decreased adhesion compared to similar layers containing granular conductive tin oxide particles.

A photographic element comprising an electrically-conductive layer containing colloidal "amorphous" silver-doped vanadium pentoxide and a transparent magnetic recording layer has been disclosed in U.S. Pat. Nos. 5,395,743; 5,427,900; 5,432,050; 5,498,512; 5,514,528 and others. This colloidal vanadium oxide is composed of entangled conductive microscopic fibrils or ribbons that are 0.005–0.01 μm wide, about 0.001 μm thick, and 0.1–1 μm in length. Conductive layers containing this colloidal vanadium pentoxide prepared as described in U.S. Pat. No. 4,203,769 can exhibit low surface resistivities at very low dry weight coverages of vanadium oxide, low optical losses, and excellent adhesion of the conductive layer to film supports. However, since colloidal vanadium pentoxide readily dissolves in developer solution during wet processing, it must be protected by a nonpermeable, overlying barrier layer as taught in U.S. Pat. Nos. 5,006,451; 5,284,714; and 5,366,855. Alternatively, a film-forming sulfopolyester latex or a polyesterionomer binder can be combined with colloidal vanadium pentoxide in the conductive layer to minimize degradation during wet processing as taught in U.S. Pat. Nos. 5,427,835 and 5,360,706. Further, when a conductive layer containing colloidal vanadium pentoxide underlies a transparent magnetic layer that is free from reinforcing filler particles, the magnetic layer inherently can serve as a nonpermeable barrier layer. However, if the magnetic layer contains reinforcing filler particles, such as gamma aluminum oxide or silica fine particles, it must be crosslinked using suitable cross-linking agents in order to preserve the desired barrier properties, as taught in U.S. Pat. No. 5,432,050. The use of colloidal vanadium pentoxide dispersed with either a copolymer of vinylidene chloride, acrylonitrile, and acrylic acid or with an aqueous dispersible polyester ionomer coated on subbed polyester supports and overcoated with a transparent magnetic recording layer is taught in U.S. Pat. No. 5,514,528. The use of an aqueous dispersible polyurethane, polyesterionomer binder or vinylidene chloride-containing copolymer with colloidal vanadium pentoxide in a conductive subbing layer underlying a solvent-coated transparent magnetic layer is taught in copending commonly assigned U.S. Ser. No. 08/662,188, filed Jun. 12, 1996.

The requirements for an electrically-conductive layer to be useful in an imaging element are extremely demanding and thus the art has long sought to develop improved conductive layers exhibiting a balance of the necessary chemical, physical, optical, and electrical properties. As indicated hereinabove, the prior art for electrically-conductive layers useful for imaging elements is extensive and a wide variety of suitable electroconductive materials have been disclosed. However, there is still a critical need in the art for improved electrically-conductive layers which can be used in a wide variety of imaging elements, which can be manufactured at a reasonable cost, which are resistant to the effects of humidity change, which are durable and abrasion-resistant, which do not exhibit adverse sensitometric or photographic effects, and which are substantially insoluble in solutions with which the imaging element comes in contact, such as the processing solutions used for silver halide photographic films. Further, to provide both effective magnetic recording properties and effective electrical-conductivity characteristics in an imaging element, without impairing its imaging characteristics, poses a considerably greater technical challenge.

It is toward the objective of providing a combination of transparent magnetic and electrically-conductive layers that more effectively meet the diverse needs of imaging elements, especially those of silver halide photographic films, but also of a wide variety of other types of imaging elements than those of the prior art that the present invention is directed.

SUMMARY OF THE INVENTION

The present invention is an imaging element which includes a support, an image-forming layer, a transparent magnetic recording layer, and a transparent electrically-conductive layer. The electrically-conductive layer contains acicular, crystalline, single phase electrically-conductive metal-containing particles having a cross-sectional diameter less than or equal to 0.02 μm and an aspect ratio greater than or equal to 5:1 dispersed in a film-forming polymeric binder. The transparent magnetic layer contains ferromagnetic fine particles dispersed in a film-forming polymeric binder.

DESCRIPTION OF THE PREFERRED EMBODIMENTS

The combination of transparent, electrically-conductive and transparent magnetic recording layers of this invention is useful for many different types of imaging elements including, for example, photographic, electrostatographic, photothermographic, migration, electrothermographic, dielectric recording, and thermal-dye-transfer imaging elements.

Photographic imaging elements which can be provided with antistatic and magnetic recording layers in accordance with this invention can differ widely in structure and composition. For example, they can vary greatly in regard to the type of support, the number and composition of the image-forming layers, and the number and kinds of auxiliary layers that are included in the elements. In particular, photographic elements can be still films, motion picture films, x-ray films, graphic arts films, paper prints or microfiche. They can be black-and-white elements, color elements adapted for use in negative-positive process or color elements adapted for use in a reversal process. It is also specifically contemplated to use the antistatic and magnetic recording layers according to the present invention with technology useful in small format film as described in *Research Disclosure*, Item 36230 (June, 1994). *Research Disclosure* is published by Kenneth Mason Publications, Ltd., Dudley House, 12 North Street, Emsworth, Hampshire PO10 7DQ, ENGLAND.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, and copolymers thereof, polycarbonate film, glass plates, metal plates, reflective supports such as paper, polymer-coated paper, and the like. The image-forming layer or layers of the element typically comprise a radiation-sensitive agent, e.g., silver halide, dispersed in a hydrophilic water-permeable colloid. Suitable hydrophilic colloids include both naturally-occurring substances such as proteins, for example, gelatin, gelatin derivatives, cellulose derivatives, polysaccharides such as dextran, gum arabic, starch derivatives, and the like, and synthetic polymeric substances such as water-soluble polyvinyl compounds such as poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly (ethylene terephthalate) as described in U.S. Pat. 3,245, 833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure*, June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal*, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography*, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. Nos. 4,343,880 and 4,727,008.

All of the imaging processes described hereinabove, as well as many others, have in common the use of an electrically-conductive layer as an electrode or as an antistatic layer.

This invention provides a transparent electrically-conductive layer for use in an imaging element which also comprises a transparent magnetic recording layer and an image forming layer. Said image-forming layer can be any of the types of image-forming layers described hereinabove, as well as any other image-forming layer known for use in an imaging element. Said electrically-conductive layer comprises electrically-conductive, acicular, fine particles dispersed in one or more suitable film-forming polymeric binder(s). The electroconductive properties provided by the conductive layer of this invention are essentially independent of relative humidity and persist even after exposure to aqueous solutions with a wide range of pH values (e.g., $2 \leqq pH \leqq 13$) such as are encountered in the wet-processing of silver halide photographic films. Thus, it is not generally necessary to provide a protective overcoat overlying the conductive layer, although optional protective layers may be present.

The acicular conductive particles used in accordance with this invention are single phase, crystalline, and have nanometer-size dimensions. Suitable dimensions for the acicular conductive particles of this invention are less than 0.05 μm in diameter and less than 1 μm in length, with less than 0.02 μm in diameter and less than 0.5 μm in length preferred and less than 0.01 μm in diameter and less than 0.15 μm in length more preferred. These dimensions tend to minimize optical losses of the coated layers due to Mie scattering. An aspect ratio of greater than or equal to 5:1 (length/diameter) is preferred and an aspect ratio of greater than 10:1 is more preferred. An increase in aspect ratio results in an improvement in volumetric efficiency of conductive network formation.

One particular class of acicular conductive particles comprises acicular electrtically-conductive metal-containing particles. Preferred metal-containing particles are semiconductive metal oxide particles. Acicular conductive metal oxide particles suitable for use in conductive layers of this invention are those which exhibit a specific (volume) resistivity of less than $1\times10^5$ ohm-cm, more preferably less than $1\times10^3$ ohm-cm, and most preferably, less than $1\times10^2$ ohm-cm. One example of a suitable acicular semiconductive metal oxide is an electroconductive tin oxide powder available under the tradename "FS-10P" from Ishihara Techno Corporation. This tin-oxide comprises acicular particles of single phase, crystalline tin oxide which is doped with antimony. The specific (volume) resistivity of this material is about 50 ohm-cm measured as a packed powder using a DC two-probe test cell similar to that described in U.S. Pat. No. 5,236,737. The mean dimensions of these acicular particles as determined from image analysis of transmission electron micrographs are approximately 0.01 μm in diameter and 0.1 μm in length with a mean aspect ratio of about 10:1. An x-ray powder diffraction analysis of this acicular tin oxide has confirmed that is single phase and highly crystalline. The x-ray crystallite size of this acicular antimony-doped tin oxide was determined to be 21.0 nm.

Additional examples of acicular metal-containing particles include metal carbides, nitrides, silicides and borides. Other suitable examples of acicular conductive metal oxides particles include tin-doped indium sesquioxide, niobium-doped titanium dioxide, and the alkali metal bronzes of tungsten, molybdenum or vanadium.

Acicular conductive metal oxide particles described in the prior art typically consist of a nonconductive core particle with a conductive outer shell. This conductive shell can be prepared by the chemical precipitation or vapor phase deposition of conductive fine particles onto the surface of the nonconductive core particle. Several serious deficiencies are manifested when such core/shell-type conductive particles are used in conductive layers for imaging elements. Because it is necessary to prepare the core particle and then coat it with fine conductive particles in a separate operation, the diameter of the resulting composite conductive particle is typically 0.1–0.5 μm or larger. The lengths of these particles typically range from 1–5 μm. These large particle sizes result in increased light scattering and hazy coatings that are not acceptable for imaging elements. Further, in the process of mechanically dispersing these core/shell-type particles, the thin conductive shells are often abraded from the surface resulting in decreased conductivity for coated layers containing these damaged particles. In addition, the large overall particle size results in the formation of fine cracks in coated layers that produces decreased wet and dry adhesion to the support and overlying or underlying layers. This cracking also leads to a decrease in the cohesion of the conductive layer itself that can result in increased dust formation during finishing operations. However, these deficiencies are notably absent from conductive layers of this invention.

The small average dimensions of the acicular conductive metal-containing particles of this invention minimize light scattering which would result in reduced optical transparency of the conductive layers. The relationship between the size of a nominally spherical particle, the ratio of its refractive index to that of the medium in which it is incorporated, the wavelength of the incident light, and the light scattering efficiency of the particle is described by Mie scattering theory (G. Mie, *Ann. Physik.*, 25, 377 (1908)). A discussion of this topic as it is relevant to photographic applications has been presented by T. H. James ("The Theory of the Photographic Process", 4th ed, Rochester: EKC, 1977). In the case of high refractive index antimony-doped tin oxide granular particles coated in a thin layer with typical gelatin binder, it is necessary to use particles with an average diameter less than about 0.1 μm in order to limit the scattering of light at a wavelength of 550 nm to less than about 10 percent. For shorter wavelength light, such as the ultraviolet light used to expose daylight insensitive graphic arts films, granular particles less than about 0.05 μm in diameter are more preferred.

In addition to ensuring transparency of the conductive layers, the small average dimensions of acicular conductive metal oxide particles in accordance with this invention promote the formation of a multitude of interconnected chains or networks of conductive particles which in turn provide a multiplicity of electrically-conductive pathways in thin coated layers. The high aspect ratio of such acicular particles results in greater efficiency of conductive network formation compared to nominally spherical conductive particles of comparable cross-sectional diameter. This permits lower volume fractions of acicular conductive particles relative to polymeric binder to be used in the coated layers to obtain effective levels of electrical-conductivity.

It is an especially important feature of this invention that it permits the achievement of high levels of electrical conductivity with the use of relatively low volume fractions of acicular conductive metal oxide particles. Accordingly, in the imaging elements of this invention, the acicular conductive metal oxide particles can constitute about 2 to 70 volume percent of the electrically-conductive layer. For the acicular antimony-doped tin oxide particles described hereinabove, this corresponds to tin oxide to polymeric binder weight ratios of from approximately 1:9 to 19:1. Use of significantly less than about 2 volume percent of the acicular conductive metal oxide particles will not provide a useful level of electrical conductivity for the coated layers. On the other hand, use of significantly more than 70 volume percent of the acicular conductive metal oxide particles defeats several of objectives of the invention in that it results in reduced transparency and increased haze due to scattering losses, diminished adhesion between the electrically-conductive layer and the support as well as underlying and/or overlying layers, and decreased cohesion of the conductive layer itself. When the conductive layers of this invention are to be used as electrodes in imaging elements, the acicular conductive metal oxide particles preferably should constitute 40 to 70 volume percent of the layer in order to obtain a suitable level of conductivity. When used as antistatic layers, it is especially preferred to incorporate the acicular conductive metal oxide particles in an amount of from 5 to 50 volume percent of the electrically-conductive layer. The use of less than 50 volume percent of acicular conductive metal oxide particles results in increased transparency, decreased haze, and improved adhesion to the underlying and overlying layers as well as increased cohesion within the conductive layer itself. Further, a lower metal oxide particle weight fraction may lead to decreased tool wear and dirt generation in finishing operations.

Binders suitable for use in electrically-conductive layers containing acicular conductive metal oxide particles include: water soluble film-forming hydrophilic polymers such as gelatin, gelatin derivatives, maleic acid anhydride copolymers; cellulose derivatives such as carboxymethyl cellulose, hydroxyethyl cellulose, hydroxypropyl methylcellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of various polyurethanes or polyesterionomers. Preferred polymers include gelatin, aqueous dispersed polyurethanes, polyesterionomers, cellulose derivatives, and vinylidene chloride-containing copolymers.

Solvents useful for preparing dispersions and coatings of acicular conductive metal oxide particles include: water; alcohols such as methanol, ethanol, propanol, isopropanol, n-butanol, isobutanol and methylcyclohexanol; ketones such as acetone, methylethyl ketone, cyclohexanone, tetrahydrofuran, isophorone and methylisobutyl ketone; esters such as methyl acetate, ethyl acetate, butyl acetate, isobutyl acetate, isopropyl acetate and ethyl lactate; ethers such as ethyl ether and dioxane; glycol ethers such as methyl cellusolve, ethyl cellusolve, glycol dimethyl ethers, and ethylene glycol; aromatic hydrocarbons such as benzene, toluene, xylene, cresol, chlorobenzene, styrene, and dichlorobenzene; chlorinated hydrocarbons such as methylene chloride, ethylene chloride, carbon tetrachloride, chloroform and ethylene chlorohydrin; and others such as N,N-dimethylformamide and hexane, and mixtures thereof. Preferred solvents include water, alcohols, and acetone.

In addition to binders and solvents, other components that are well known in the photographic art may also be present in the conductive layer. These additional components include: surfactants including fluoro-surfactants, dispersing and coating aids, thickeners, crosslinking agents or hardeners, soluble and/or solid particle dyes, co-binders, antifoggants, biocides, matte beads, lubricants, and others.

Dispersions of acicular conductive metal oxide particles in a suitable solvent can be prepared in the presence of appropriate levels of optional dispersing aids or optional co-binders by any of various mechanical stirring, mixing, homogenization or blending processes well-known in the art of pigment dispersion and paint making.

Dispersions of acicular conductive metal oxide particles formulated with binders and additives can be coated onto a variety of photographic supports. Typical photographic film supports include cellulose nitrate film, cellulose acetate film, cellulose acetate butyrate, cellulose acetate propionate, poly (vinyl acetal) film, poly(carbonate) film, poly(styrene) film, poly(ethylene terephthalate) film, poly(ethylene naphthalate) film, polyethylene terephthalate or polyethylene naphthalate having included therein a portion of isophthalic acid, 1,4-cyclohexane dicarboxylic acid, or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Preferred photographic film supports are cellulose acetate, poly(ethylene terephthalate), and poly (ethylene naphthalate) and most preferably that the poly (ethylene naphthalate) be prepared from 2,6-naphthalene dicarboxylic acids or derivatives thereof. Photographic film supports can be either transparent or opaque depending upon the application. Transparent film supports can be either colorless or colored by the addition of a dye or pigment. Photographic film supports can be surface-treated by various processes including corona discharge, glow discharge, UV exposure, flame treatment, e-beam treatment, solvent washing, and treatment with an adhesion-promoting agent including dichloro- and trichloro-acetic acid, phenol derivatives such as resorcinol and p-chloro-m-cresol, or overcoated with adhesion-promoting primer or tie layers containing polymers such as vinylidene chloride-containing copolymers, butadiene-based copolymers, glycidyl acrylate or methacrylate containing copolymers, maleic anhydride containing copolymers, condensation polymers such as polyesters, polyamides, polyurethanes, polycarbonates, mixtures and blends thereof, and the like.

Other supports for imaging elements which may be transparent or opaque include glass plates, metal plates, reflective supports such as paper, polymer-coated paper, pigment-containing polyesters and the like. Suitable paper supports include polyethylene-, polypropylene-, and ethylene-butylene copolymer-coated or laminated paper and synthetic papers.

The formulated dispersions containing acicular metal oxide particles can be applied to the aforementioned film or paper supports by any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, and other coating methods well known in the art.

The electrically-conductive layer of this invention can be applied to the support at any suitable coverage depending on the particular requirements of the type of imaging element involved. For silver halide photographic films, preferred coverages of acicular antimony-doped tin oxide in the conductive layer typically include dry coating weights in the range of from about 0.005 to about 1 g/m$^2$. More preferred coverages are in the range of about 0.01 to 0.5 g/m$^2$.

The electrically-conductive layer of this invention typically exhibits a surface resistivity of less than $1\times10^{10}$ ohms/square, preferably less than $1\times10^{9}$ ohms/square, and more preferably less than $1\times10^{8}$ ohms/square.

Conductive layers of this invention can be applied to a support in any of various configurations depending upon the requirements of the specific imaging element. In a photographic imaging element, for example, the conductive layer can be applied as a subbing layer or tie layer on either side or both sides of the film support. When a conductive layer containing acicular metal oxide particles is applied as a subbing layer under a sensitized emulsion layer, it is not necessary to apply any intermediate layers such as barrier layers or adhesion promoting layers between it and the sensitized emulsion layer, although they can optionally be present. In another type of photographic element, a conductive subbing layer is applied to only one side of the support and sensitized emulsion layers coated on both sides of the support. In the case of a photographic element that contains a sensitized emulsion layer on one side of the support and a pelloid layer containing gelatin on the opposite side of the support, the conductive layer can be coated either under the sensitized emulsion layer or under the pelloid as part of a multi-component curl-control layer or on both sides of the support. Additional optional layers can be present as well. In yet another type of photographic element, a conductive subbing layer can be applied either under or over a gelatin subbing layer containing an antihalation dye or pigment. Alternatively, both antihalation and antistatic functions can be combined in a single layer containing acicular conductive particles, antihalation dye, and a binder. This hybrid layer is typically coated on the same side of the support as the sensitized emulsion layer. The conductive layer also can be used as the outermost layer of an imaging element, for example, as a protective layer overlying an image-forming layer. Alternatively, a conductive layer also can function as an abrasion-resistant backing layer applied on the side of the support opposite to the image-forming layer. Other addenda, such as polymer lattices to improve dimensional stability, hardeners or cross-linking agents, surfactants, and various other well-known additives can be present in any or all of the above mentioned layers.

Imaging elements comprising a transparent magnetic recording layer are well known in the imaging art and are described, for example, in U.S. Pat. Nos. 3,782,947; 4,279,945; 4,302,523; 4,990,276; 5,147,768; 5,215,874; 5,217,804; 5,227,283; 5,229,259; 5,252,441; 5,254,449; 5,294,525; 5,335,589; 5,336,589; 5,382,494; 5,395,743; 5,397,826; 5,413,900; 5,427,900; 5,432,050; 5,457,012; 5,459,021; 5,491,051; 5,498,512; 5,514,528 and others; and in *Research Disclosure*, item No. 34390 (November, 1992). Such elements are particularly advantageous because they can be employed to record images by the customary imaging processes while at the same time additional information can be recorded into and read from a transparent magnetic layer by techniques similar to those employed in the magnetic recording art. Said transparent magnetic recording layer comprises a film-forming polymeric binder, ferromagnetic particles, and other optional addenda for improved manufacturabilty or performance such as dispersants, coating aids, fluorinated surfactants, crosslinking agents or hardeners, catalysts, charge control agents, lubricants, abrasive particles, filler particles, plasticizers and the like.

Suitable ferromagnetic particles comprise ferromagnetic iron oxides, such as: $\gamma$-$Fe_2O_3$, $Fe_3O_4$; $\gamma$-$Fe_2O_3$ or $Fe_3O_4$ with Co, Zn, Ni or other metals in solid solution or surface-treated; ferromagnetic chromium dioxides such as $CrO_2$ or $CrO_2$ with Li, Na, Sn, Pb, Fe, Co, Ni, Zn or halogen atoms in solid solution; ferromagnetic hexagonal ferrites, such as barium and strontium ferrite; ferromagnetic metal alloys with protective oxide coatings on their surface to improve chemical stability. Other surface-treatments of magnetic particles to increase chemical stability or improve dispersability known in the conventional magnetic recording art may also be practiced. In addition, ferromagnetic oxide particles can be overcoated with a shell consisting of a lower refractive index particulate inorganic material or a polymeric material with a lower optical scattering cross-section as taught in U.S. Pat. Nos. 5,217,804 and 5,252,444. Suitable ferromagnetic particles can exhibit a variety of sizes, shapes, and aspect ratios. The preferred ferromagnetic particles for use in transparent magnetic layers used in combination with the electrically-conductive layers of this invention are cobalt surface-treated $\gamma$-$Fe_2O_3$ or magnetite with a specific surface area greater than 30 m$^2$/g.

As taught in U.S. Pat. No. 3,782,947, whether an element is useful for both photographic and magnetic recording depends both on the size distribution and the concentration of the ferromagnetic particles and on the relationship between the granularities of the magnetic and photographic layers. Generally, the coarser the grain of the silver halide emulsion in the photographic element containing a magnetic recording layer, the larger the mean size of the magnetic particles which are suitable. A magnetic particle coverage for the magnetic layer of from about 10 to 1000 mg/m$^2$, when uniformly distributed across the imaging area of a photographic imaging element, provides a magnetic layer that is suitably transparent to be useful for photographic imaging applications for magnetic particles with a maximum particle size of less than about 1 μm. Magnetic particle coverages less than about 10 mg/m$^2$ tend to be insufficient for magnetic recording purposes. Magnetic particle coverages greater than about 1000 mg/m$^2$ tend to produce magnetic layers with optical densities too high for photographic imaging. Particularly useful particle coverages are in the range of 20 to 70 mg/m$^2$. Coverages of about 20 mg/m$^2$ are particularly useful in transparent magnetic layers for reversal films and coverages of about 40 mg/m$^2$ are particularly useful in transparent magnetic layers for negative films. Magnetic particle volume concentrations in the coated layers of from about $1\times10^{-11}$ mg/mm$^3$ to $1\times10^{-10}$ mg/mm$^3$ are particularly preferred for transparent magnetic layers prepared for use in photographic elements of this invention. A typical thickness for the transparent magnetic layer is in the range from about 0.05 to 10 μm.

Suitable ploymeric binders for use in the magnetic layer include, for example: vinyl chloride based copolymers such as, vinyl chloride-vinyl acetate copolymers, vinyl chloride-vinyl acetate-vinyl alcohol terpolymers, vinyl chloride-vinyl acetate-maleic acid terpolymers, vinyl chloride-vinylidene chloride copolymers, vinyl chloride-acrylonitrile copolymers ; acrylic ester-acrylonitrile copolymers, acrylic ester-vinylidene chloride copolymers, methacrylic ester-vinylidene chloride copolymers, methacrylic ester-styrene copolymers, thermoplastic polyurethane resins, phenoxy resins, polyvinyl fluoride, vinylidene chloride-acrylonitrile copolymers, butadieneacrylonitrile copolymers, acrylonitrile-butadieneacrylic acid terpolymers, acrylonitrile-butadienemethacrylic acid terpolymers, polyvinyl butyral, polyvinly acetal, cellulose derivatives such as cellulose esters including cellulose nitrate, cellulose acetate, cellulose diacetate, cellulose triacetate, cellulose acetate butyrate, cellulose acetate proprionate, and mixtures thereof, and the like; styrene-butadiene copolymers, polyester resins, phenolic resins, epoxy resins, thermosetting polyurethane resins, urea resins, melamine resins, alkyl resins, urea-formaldehyde resins and other synthetic resins. Preferred binders for organic solvent-coated transparent magnetic layers are polyurethanes, vinyl chloride-based copolymers and cellulose esters, particularly cellulose diacetate and cellulose triacetate.

The binder for transparent magnetic layers can also be film-forming hydrophilic polymers such as water soluble polymers, cellulose ethers, latex polymers and water soluble polyesters as described in *Research Disclosures* Nos. 17643 (December, 1978) and 18716 (November, 1979) and U.S. Pat. Nos. 5,147,768; 5,457,012; 5,520,954 and 5,531,913. Suitable water-soluble polymers include gelatin, gelatin derivatives, casein, agar, starch derivatives, polyvinyl alcohol, acrylic acid copolymers, and maleic acid anhydride. Suitable cellulose ethers include carboxymethyl cellulose and hydroxyethyl cellulose. Other suitable aqueous binders include aqueous lattices of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl chloride copolymers and vinylidene chloride copolymers, and butadiene copolymers and aqueous dispersions of polyurethanes or polyesterionomers. The preferred hydrophilic binders are gelatin, gelatin derivatives and combinations of gelatin with a polymeric cobinder. The gelatin may be any of the so-called alkali- or acid-treated gelatins.

Optionally, the binder in the magnetic layer may be cross-linked. Binders which contain active hydrogen atoms including —OH, —$NH_2$, —NHR, where R is an organic radical, and the like, can be crosslinked using an isocyanate or polyisocyanate as described in U.S. Pat. No. 3,479,310. Suitable polyisocyanates include: tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, polymers of the forgoing, polyisocyanates prepared by reacting an excess of an organic diisocyanate with an active hydrogen containing compounds such as polyols, polyethers and polyesters and the like, including ethylene glycol, propylene glycol, dipropylene glycol, butylene glycol, trimethylol propane, hexanetriol, glycerine sorbitol, pentaerythritol, castor oil, ethylenediamine, hexamethylenediamine, ethanolamine, diethanolamine, triethanolamine, water, ammonia, urea, and the like, including biuret compounds, allophanate compounds and the like. A preferred polyisocyanate crosslinking agent is the reaction product of trimethylol propane and 2,4-tolylene diisocyanate sold by Mobay under the tradename Mondur CB 75.

The hydrophilic binders can be hardened using any of a variety of means known to one skilled in the art. Useful hardening agents include aldehyde compounds such as formaldehyde, ketone compounds, isocyanates, aziridine compounds, epoxy compounds, chrome alum, and zirconium sulfate.

Examples of suitable solvents for coating the transparent magnetic layer include: water; ketones, such as acetone, methyl ethyl ketone, methylisobutyl ketone, tetrahydrofuran, and cyclohexanone ; alcohols, such as methanol, ethanol, isopropanol, and butanol; esters such as ethyl acetate and butyl acetate, ethers; aromatic solvents, such as toluene; and chlorinated hydrocarbons, such as carbon tetrachloride, chloroform, dichloromethane; trichloromethane, trichloroethane; glycol ethers such as ethylene glycol monomethyl ether, and propylene glycol monomethyl ether; and ketoesters, such as methylacetoacetate. Optionally, due to the requirements of binder solubility, magnetic dispersability and coating rheology, a mixture of solvents may be advantageous. A preferred solvent mixture consists of a chlorinated hydrocarbon, ketone and/or alcohol, and ketoesters. Another preferred solvent mixture consists of a chlorinated hydrocarbon, ketone and/or alcohols, and a glycol ether. Preferred solvent mixtures include dichloromethane, acetone and/or methanol, methylacetoacetate; dichloromethane, acetone and/or methanol, propylene glycol monomethyl ether; and methylethyl ketone, cyclohexanone and/or toluene.

As indicated hereinabove, the transparent magnetic layer also may contain additional optional components such as dispersing agents, wetting agents, surfactants or fluorinated surfactants, coating aids, viscosity modifiers, soluble and/or solid particle dyes, antifoggants, matte particles, lubricants, abrasive particles, filler particles, and other addenda that are well known in the photographic and magnetic recording arts.

Useful dispersing agents include fatty acid amines, and commercially available wetting agents such as Witco Emcol CC59 which is a quaternary amine available from Witco Chemical Corp; Rhodofac PE 510, Rhodofac RE 610, Rhodofac RE 960, and Rhodofac LO 529 which are phosphoric acid esters available from Rhone-Poulenc; and polyethylene oxide-based copolymers which are commercially available as Solsperse 17000, Solsperse 20000, and Solsperse 24000 from Zeneca, inc. or PS2 and PS3 from ICI.

Suitable coating aids include nonionic fluorinated alkyl esters such as, FC-430 and FC-431 sold by Minnesota Mining and Manufacturing,; polysiloxanes such as DC 1248, DC 200, DC 510, DC 190 sold by Dow Corning; and BYK 310, BYK 320, and BYK 322 sold by BYK Chemie; and SF 1079, SF 1023, SF 1054, and SF 1080 sold by General Electric.

Examples of reinforcing filler particles include nonmagnetic inorganic powders with a Moh scale hardness of at least 6. Examples of suitable metal oxides include gamma alumina, chromium (+3) oxide, alpha iron oxide, tin oxide, silica, titania, aluminosilicates, such as zeolites, clays and clay-like materials. Other suitable filler particles include various metal carbides, nitrides, and borides. Preferred filler particles include gamma alumina and silica as taught in U.S. Pat. No. 5,432,050.

Abrasive particles exhibit properties similar to those of reinforcing particles and include some of the same materials, but are typically much larger in size. Abrasive particles are present in the transparent magnetic layer to aid in cleaning of the magnetic heads as is well-known in the magnetic recording art. Preferred abrasive particles are alpha aluminum oxide and silica as disclosed in *Research Disclosure*, Item No. 36446 (August 1994).

Additional layers present in imaging elements in accordance with this invention either above or below the transparent magnetic layer may include but are not limited to abrasion and scratch resistant layers, other protective layers, abrasive-containing layers, adhesion-promoting layers, antihalation layers and lubricant-containing layers overlying the magnetic layer for improved film conveyance and runnability during magnetic reading and writing operations.

Suitable lubricants include silicone oil, silicones or modified silicones, fluorine-containing alcohols, fluorine-containing esters, polyolefins, polyglycols, alkyl phosphates and alkali metal salts thereof, polyphenyl ethers, fluorine-containing alkyl sulfates and alkali metal salts thereof, monobasic fatty acids having 10 to 24 carbon atoms and metal salts thereof, alcohols having 12 to 22 carbon atoms, alkoxy alcohols having 12 to 22 carbon atoms, esters of monobasic fatty acids having one of monovalent, divalent, trivalent, tetravalent, pentavalent and hexavalent alcohols, fatty acid esters of monoalkyl ethers of alkylene oxide polymers, fatty acid amides and aliphatic amines.

Specific examples of these compounds (i.e., alcohols, acids or esters) include lauric acid, myristic acid, palmitic acid, stearic acid, behenic acid, butyl stearate, oleic acid, octyl stearate, amyl stearate, isocetyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Carnauba wax is preferred.

The transparent magnetic layer can be positioned in an imaging element in any of various positions. For example, it can overlie one or more image-forming layers, or underlie one or more image forming layers, or be interposed between image-forming layers, or serve as a subbing layer for an image-forming layer, or be coated on the side of the support opposite to an image-forming layer. A transparent magnetic layer also may be co-extruded as a thin outer layer onto the support in the case of polyester support materials as described in U.S. Pat. No. 5,188,789. In the particular case of a thermal dye transfer imaging element, a transparent magnetic layer may be incorporated in the thermal dye donor transfer sheet, as disclosed in U.S. Ser. No. 08/599,692 filed Feb. 12,1996.

The conductive layer of this invention may be present as a subbing or tie layer underlying the magnetic layer or as a topcoat layer or protective layer overlying the magnetic layer. Conductive layers also may be located on the side of the support opposite the magnetic layer or on both sides of the support. However, in a silver halide photographic element the conductive layer is generally located on the same side of the support as the magnetic layer opposite the silver halide emulsion layers. The internal resistivity of an antistatic layer of this invention containing acicular conductive metal oxide particles underlying a transparent magnetic layer in a photographic element is typically less than about $1\times10^{10}$ ohms/square, preferably less than $1\times10^{9}$ ohms/square, and more preferably less than $1\times10^{10}$ ohms/square.

In imaging elements comprising polyester supports, the magnetic and conductive layers may be co-extruded as thin outer layers on top of the support.

The conductive and magnetic recording functions can be accomplished more advantageously by incorporating both the acicular conductive metal oxide particles of this invention and ferromagnetic particles in suitable concentrations and proportions with a suitable film-forming binder in a single layer. Such combined function layers have been disclosed in U.S. Pat. Nos. 5,147,768; 5,427,900; 5,459,021; and others for various granular conductive metal oxide particles and in Japanese Kokai No. 07-159912 for granular conductive tin oxide particles.

Photographic elements comprising transparent magnetic layers and conductive layers in accordance with this invention also comprise at least one photosensitive layer. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure*, Vol. 176, Item 17643 (December, 1978), *Research Disclosure*, Vol. 225, Item 22534 (January, 1983), *Research Disclosure*, Item 36544 (September, 1994), and *Research Disclosure*, Item 37038 (February, 1995) are useful in preparing photographic elements in accordance with this invention. Photographic elements in accordance with this invention can be either single color elements or multicolor elements. Generally, the photographic element is prepared by coating the film support on the side opposite the magnetic recording layer with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Imaging elements in accordance with this invention comprising conductive layers containing acicular metal oxide particles in combination with transparent magnetic recording layers, which are highly useful for specific photographic imaging applications such as color negative films, color reversal films, black-and-white films, small format films as described in *Research Disclosure*, Item 36230 (June, 1994), color and black-and-white papers, etc., can be prepared by those procedures described hereinabove.

The present invention is further illustrated by the following examples of its practice. However, the scope of this invention is by no means restricted to or limited by these specific illustrative examples.

EXAMPLE 1

An antistatic layer coating formulation comprising conductive acicular antimony-doped tin oxide particles dispersed in water with a polyurethane latex binder, dispersants, coating aids, crosslinkers, and the like as optional additives was applied using a coating hopper to a moving web of polyethylene terephthalate that had been previously surface-treated by a corona discharge treatment. The coating formulation is given below:

| Component | Weight % (dry) | Weight % (wet) |
|---|---|---|
| acicular conductive $SnO_2$* | 77.30 | 1.789 |
| polyurethane binder (W-236)+ | 19.33 | 0.447 |
| dispersant (Dequest 2006)@ | 1.93 | 0.045 |
| wetting aid (Triton X-100)# | 1.44 | 0.033 |
| water | 0.00 | (balance) |

*FS-10P, Ishihara Techno Corp.
+Witcobond W-236, Witco Corp.
@Dequest 2006, Monsanto Chemical Co.
#Triton X-100, Rohm & Haas The above coating formulation was applied at various vet coverages ranging from 8 to 20 $cm^3/m^2$ corresponding to nominal total dry coverages from 0.20 to 0.50 $g/m^2$. The resulting antistatic layers were overcoated with a transparent magnetic recording layer as described in *Research Disclosure*, Item 34390 (November, 1992). The transparent magnetic recording layer comprises cobalt surface-modified $\gamma$-$Fe_2O_3$ particles in a polymeric binder which optionally may be cross-linked and optionally may contain suitable abrasive particles. The polymeric binder comprises a blend of cellulose diacetate and cellulose triacetate. Total dry coverage of the magnetic layer was nominally 1.5 $g/m^2$. An optional lubricant-containing layer comprising carnauba wax and a fluorinated surfactant as a wetting aid was applied over the transparent magnetic recording layer to give a nominal dry coverage of about 0.02 $g/m^2$. The resultant multilayer structure comprising an electrically-conductive antistatic layer overcoated with a transparent magnetic recording layer, an optional lubricant layer, and other additional optional layers is referred to herein as a "backings package." Said backings packages were evaluated for antistatic performance, dry adhesion, wet adhesion, optical and ultraviolet densities.

Antistatic performance was evaluated by measuring the internal resistivities of the overcoated electrically-conductive antistatic layers using a salt bridge wet electrode resistivity (WER) measurement technique (see, for example, "Resistivity Measurements on Buried Conductive Layers" by R. A. Elder, pages 251–254, 1990 *EOS/ESD Symposium Proceedings*). Typically, antistatic layers with WER values greater than about $1\times10^{12}$ ohm/square are considered to be ineffective at providing static protection for photographic imaging elements. WER measurements were also obtained for samples processed using a standard C-41 process. Dry adhesion of the backings package was evaluated by scribing a small cross-hatched region into the coating with a razor blade. A piece of high tack adhesive tape was placed over the scribed region and quickly removed. The relative amount of coating removed is a qualitative measure of the dry adhesion. Wet adhesion was evaluated using a procedure which simulates wet processing of silver halide photographic elements. A one millimeter wide line was scribed into a sample of the backings package. The sample was then immersed in KODAK Flexicolor developer solution at 38° C. and allowed to soak for 3 minutes and 15 seconds. The test sample was removed from the heated developer solution and then immersed in another bath containing Flexicolor developer at about 25° C. and a rubber pad (approximately 3.5 cm dia.) loaded with a 900 g weight was rubbed vigorously back and forth across the sample in the direction perpendicular to the scribe line. The relative amount of additional material removed is a qualitative measure of the wet adhesion of the various layers. Total optical and ultraviolet densities ($D_{min}$) of the backings packages were measured using a X-Rite Model 361T densitometer at 530 and 380 nm, respectively. The contributions of the polymeric support (and any optional primer layers) to the optical and ultraviolet densities were subtracted from the total $D_{min}$ values to obtain $\Delta$ UV and $\Delta$ ortho $D_{min}$ values which correspond to the net contribution of the backings package to the total ultraviolet and optical densities.

WER values measured before and after photographic processing, and net optical and ultraviolet densities for Examples 1a–d are presented in Table 1. Dry adhesion and wet adhesion results for all samples were excellent.

COMPARATIVE EXAMPLE 1

An antistatic coating formulation was prepared in a manner similar to Example 1 with a granular conductive zinc antimonate as described in U.S. Pat. No. 5,368,995 substituted for the acicular conductive tin oxide of this invention. The coating formulation is given below.

| Component | Weight % (dry) | Weight % (wet) |
|---|---|---|
| granular $ZnSb_2O_6$* | 78.83 | 1.789 |
| polyurethane binder (W-236) | 19.71 | 0.447 |
| wetting aid (Triton X-100) | 1.47 | 0.033 |
| water | 0.00 | (balance) |

*Celnax CX-Z Nissan Chemical Industries, Ltd.

The above antistatic coating formulation comprising conductive zinc antimonate particles dispersed with a polyurethane binder and optional additives was applied to a moving web of polyethylene terephthalate which had been surface-treated by corona discharge to give nominal total dry coverages from 0.20 to 0.50 $g/m^2$. The resulting antistatic layers were subsequently overcoated with a transparent magnetic recording layer and an optional lubricant layer as in Example 1. WER values, dry and wet adhesion results, and net optical and ultraviolet densities were obtained as in Example 1 and are presented in Table 1.

A comparison of Example 1 with Comparative Example 1 illustrates that conductive layers containing the acicular conductive tin oxide of the present invention exhibit antistatic performance superior to those containing granular conductive zinc antimonate of the prior art in backings packages suitable for use in imaging elements containing a transparent magnetic recording layer. As indicated in Table 1, the use of acicular conductive tin oxide of the present invention results in lower internal resistivity values for backings packages than those containing granular zinc antimonate particles. Significantly, even at the lowest total dry coverages (0.20 $g/m^2$) the backings containing the acicular conductive tin oxide particles exhibit significantly lower WER values than those with the highest total dry coverages of granular zinc antimonate. Clearly, a substantial improvement in antistatic performance can be obtained at lower total dry coverage of conductive particles with the acicular conductive particles of this invention. In addition, a beneficial decrease in the net optical densities of the backings package results from lower total dry coverage. Furthermore, even for equivalent total dry coverages, coatings containing the conductive acicular particles of this invention exhibit lower net ultraviolet densities. In especially demanding applications, such as those including a transparent magnetic recording layer, any decrease in optical density is significant in order to partially compensate for the large contribution to the total optical density by the magnetic layer. The substantial reduction in ultraviolet density, even at equivalent dry coverages, is particularly advantageous for those backings packages containing a transparent magnetic recording layer that are intended for use in films exposed using shorter wavelength light, such as ultraviolet light. The improved antistatic performance of the conductive layers of the present invention permits the use of lower conductive particle dry coverages and consequently results in reduced net optical density values, potentially less tool wear during finishing operations, and lower materials costs than backings packages described in the prior art.

TABLE 1

| Example | Total Dry Coverage g/m² | Raw WER log ohm/square | Processed WER log ohm/square | Dry Adhesion | Wet Adhesion | Δ UV $D_{min}$ | Δ ortho $D_{min}$ |
|---|---|---|---|---|---|---|---|
| 1a | 0.20 | 6.5 | 6.2 | excellent | excellent | 0.163 | 0.055 |
| 1b | 0.30 | 6.2 | 5.9 | excellent | excellent | 0.170 | 0.058 |
| 1c | 0.40 | 6.1 | 5.7 | excellent | excellent | 0.178 | 0.062 |
| 1d | 0.50 | 6.1 | 5.7 | excellent | excellent | 0.186 | 0.063 |
| C-1a | 0.20 | 8.8 | 7.8 | excellent | excellent | 0.171 | 0.056 |
| C-1b | 0.30 | 8.4 | 7.4 | excellent | excellent | 0.186 | 0.057 |
| C-1c | 0.40 | 8.3 | 7.2 | excellent | excellent | 0.198 | 0.062 |
| C-1d | 0.50 | 8.2 | 7.0 | excellent | excellent | 0.210 | 0.064 |

EXAMPLE 2

An antistatic layer coating formulation was prepared in a manner essentially identical to Example 1. The present coating formulation was applied to a polyethylene terephthalate support that had been previously undercoated with a primer layer comprising a terpolymer latex of acrylonitrile, vinylidene chloride, and acrylic acid at appropriate wet coverages to obtain nominal total dry coverages of 0.40, 0.20, and 0.10 g/m². The resulting antistatic layers were overcoated with a transparent magnetic layer and a lubricant layer as described in Example 1. Wet and dry adhesion results, WE R values, net optical and ultraviolet densities are given in Table 2. The results obtained for the present example demonstrate that highly effective, adherent, transparent antistatic layers can be prepared in combination with a transparent magnetic recording layer using a polyester support that had been primed or undercoated with a polymeric primer layer as well as using surface-treated polyester support.

TABLE 2

| Example | Total Dry Coverage g/m² | WER log ohm/square | Dry Adhesion | Wet Adhesion | Δ UV $D_{min}$ | Δ ortho $D_{min}$ |
|---|---|---|---|---|---|---|
| 2a | 0.40 | 6.9 | excellent | excellent | 0.165 | 0.057 |
| 2b | 0.20 | 7.8 | excellent | excellent | 0.159 | 0.057 |
| 2c | 0.10 | >12.0 | excellent | excellent | 0.160 | 0.055 |
| C-2a | 0.40 | 7.9 | excellent | excellent | 0.167 | 0.060 |
| C-2b | 0.20 | 9.2 | excellent | excellent | 0.155 | 0.057 |
| C-2c | 0.10 | >12.0 | excellent | excellent | 0.159 | 0.055 |

COMPARATIVE EXAMPLE 2

Antistatic layers were prepared in a manner essentially identical to Example 2 except that a granular conductive tin oxide was substituted for the acicular conductive tin oxide of the present invention. A suitable granular antimony-doped tin oxide is taught in U.S. Pat. No. 5,484,694. Said antimony-doped tin oxide exhibits an antimony doping level of greater than 8 atom percent, an x-ray crystallite size less than 100 Å and an average primary particle diameter less than about 15 nm. The granular conductive tin oxide used for the present example is commercially available from Dupont Specialty Chemicals under the tradename ZELEC ECP 3010XC. The ECP 3010XC material has an antimony doping level of about 10.5 atom percent, an x-ray crystallite size of 50–75 Å, and an average primary particle diameter after attrition milling of about 6–8 nm. The use of said granular conductive tin oxide results in significantly higher WER values for the effective antistatic backings packages than is obtained for backings containing the acicular conductive tin oxide of the present invention. Similar net optical and ultraviolet densities are observed for backings packages containing equivalent dry coverages of the acicular or granular conductive tin oxides. However, as illustrated in Table 2, a significantly lower total dry coverage of acicular conductive tin oxide than of granular tin oxide can be used to produce equivalent values of WER for corresponding conductive layers.

EXAMPLES 3 and 4

Backings packages were prepared in a manner similar to Example 2. Acicular conductive tin oxide was dispersed with a polyurethane latex binder and other additives and applied to the support at appropriate wet coverages to give nominally 0.20 g/m² total dry coverage. The polymeric support used for Example 3 was polyethylene naphthalate which had been surface-treated by glow discharge treatment in oxygen. The polymeric support for Example 4 had been coated with a primer layer of terpolymer latex comprising acrylonitrile, vinylidene chloride, and acrylic acid. The surface electrical resistivity (SER) of the antistatic layer prior to overcoating with a magnetic layer was measured at nominally 50% relative humidity using a two-point probe DC method similar to that described in U.S. Pat. No. 2,801,191. Internal resistivity (WER) was measured after overcoating with a transparent magnetic recording layer. SER and WER values, dry and wet adhesion results, and net ultraviolet and optical densities are given in Table 3. These results demonstrate that excellent antistatic properties and adhesion can be obtained for backings packages containing a transparent magnetic recording layer for both conventionally primed and surface-treated supports. Further, conductive layers of the present invention can be applied to a variety of polymeric supports including polyethylene terephthalate and polyethylene naphthalate. Table 3 illustrates the essentially equivalent SER values for antistatic layers coated on terpolymer latex primed and surface-treated supports. After overcoating with a transparent magnetic recording layer, the internal resistivity increases for the backings packages coated on the primed support but is essentially unaltered (or even slightly more conductive) for backings packages coated on glow discharge treated support.

COMPARATIVE EXAMPLES 3 and 4

Comparative Examples 3 and 4 were prepared using glow discharge treated support and polymeric primed support, respectively, in a manner identical to Examples 3 and 4 except that the acicular conductive tin oxide of the present invention was substituted with a granular tin oxide. The backings packages containing granular conductive tin oxide particles exhibited results similar to those containing the acicular tin oxide particles of this invention for both types of support. However, the internal resistivity values are significantly higher for the former backings packages than the latter.

COMPARATIVE EXAMPLE 5

Antistatic coating formulations comprising colloidal silver-doped vanadium pentoxide as taught in U.S. Pat. No. 4,203,769 dispersed in a polyurethane binder as taught in copending commonly assigned U.S. Ser. No. 08/662,188 filed Jun. 12, 1996 were prepared and subsequently overcoated with a transparent magnetic recording layer. The weight ratio of polyurethane binder to colloidal vanadium pentoxide was 4/1 for Comparative Example 5a and nominally 25/1 for Comparative Examples 5b and 5c. The antistatic coating formulations were applied to glow discharge treated polyethylene naphthalate and overcoated with a transparent magnetic recording layer and an optional lubricant layer in a manner similar to Example 3 and Comparative Example 3. Nominal dry coverages were 0.04, 0.04, and 0.55 g/m$^2$ for Comparative Examples 5a–c, respectively. WER values, adhesion results, and Δ UV and Δ ortho $D_{min}$ values are given in Table 3. Comparative Example 5a exhibits excellent WER and Δ ortho $D_{min}$ values comparable to Example 3, but had increased Δ UV $D_{min}$ and unacceptable adhesion. In order to improve adhesion, the ratio of binder to colloidal vanadium pentoxide was increased to 25/1 in Comparative Example 5b. However, this increase resulted in a significantly higher WER value. Consequently, it was necessary to substantially increase the total dry coverage in Comparative Example 5c in order to obtain a WER value comparable to that of Example 3. Increasing the total dry coverage in order to obtain a WER value equivalent to that of Example 3, resulted in significantly greater net ultraviolet and optical densities than for the backings packages containing either granular or acicular conductive tin oxide particles. Thus, a major claimed benefit of using colloidal vanadium pentoxide gels at low coverages was lost.

TABLE 3

| Example | Support | Total Dry Coverage g/m$^2$ | SER log ohm/square | WER log ohm/square | Dry Adhesion | Wet Adhesion | Δ UV $D_{min}$ | Δ ortho $D_{min}$ |
|---|---|---|---|---|---|---|---|---|
| 3 | GDT | 0.20 | 7.2 | 6.7 | excellent | good | 0.145 | 0.051 |
| C-3 | GDT | 0.20 | 8.1 | 8.1 | excellent | fair | 0.142 | 0.051 |
| 4 | subbed | 0.20 | 6.8 | 7.8 | excellent | excellent | 0.159 | 0.057 |
| C-4 | subbed | 0.20 | 8.2 | 9.2 | excellent | excellent | 0.155 | 0.057 |
| C-5a | GDT | 0.04 | — | 6.8 | fair | poor | 0.161 | 0.051 |
| C-5b | GDT | 0.04 | — | 9.2 | excellent | excellent | 0.150 | 0.048 |
| C-5c | GDT | 0.55 | — | 6.7 | excellent | excellent | 0.203 | 0.060 |

EXAMPLE 5

Backings packages were prepared using polyethylene terephthalate support that had been undercoated with a terpolymer latex primer layer. In the present example, hydroxypropyl methylcellulose, available commercially from Dow Chemical Company under the tradename METHOCEL E4M was used as the binder in the antistatic layer. The weight ratio of acicular conductive tin oxide to binder was 85/15. The antistatic coating formulation was applied to the support to give total dry coverages ranging from 0.60 to 0.30 g/m$^2$. SER values were measured for the antistatic coating prior to overcoating with a transparent magnetic layer. The values for SER and WER, and the results for dry adhesion and wet adhesion are given in Table 4. These results demonstrate that acicular conductive tin oxide particles of the present invention can be used in backings packages that exhibit fair to excellent adhesion and excellent antistatic performance. The present example further demonstrates that it is possible to prepare antistatic layers coated on conventionally primed supports that do not exhibit significant changes in resistivity after overcoating with a transparent magnetic recording layer.

TABLE 4

| Example | Total Dry Coverage g/m$^2$ | Dry Adhesion | Wet Adhesion | SER log ohm/ square | WER log ohm/ square |
|---|---|---|---|---|---|
| 5a | 0.60 | excellent | fair | 6.3 | 6.5 |
| 5b | 0.50 | excellent | excellent | 6.1 | 6.7 |
| 5c | 0.40 | excellent | excellent | 6.3 | 7.0 |
| 5d | 0.30 | excellent | excellent | 6.5 | 7.5 |

EXAMPLE 6

Backings packages were prepared in a similar manner to Example 2 except that the polyurethane binder used in the antistatic layer was replaced by a terpolymer latex comprising acrylonitrile, vinylidene chloride and acrylic acid. The weight ratio of acicular conductive tin oxide to binder was 75/25. Antistatic coating formulations were applied to give dry coverages ranging from 0.60 to 0.20 g/m$^2$. The resulting backings packages were found to exhibit excellent adhesion. Antistatic characteristics and net ultraviolet densities ($D_{min}$) are superior to those of antistatic layers comprised of granular zinc antimonate used for Comparative Examples 6 as indicated in Table 5. The present example demonstrates that the acicular conductive tin oxide of this invention can be incorporated in antistatic layers containing other binders and exhibit excellent antistatic properties and excellent adhesion to both underlying support and an overlying transparent magnetic recording layer.

COMPARATIVE EXAMPLE 6

Comparative Example 6 was prepared in a manner identical to Example 6 except that acicular conductive tin oxide of the present invention was replaced with a granular conductive zinc antimonate as taught in U.S. Pat. No. 5,457,013. The WER values and the net ultraviolet densities for the resulting backings packages are all higher than those of Example 6.

TABLE 5

| Example | Total Dry Coverage g/m$^2$ | WER log ohm/square | Dry Adhesive | Wet Adhesive | Δ UV $D_{min}$ | Δ ortho $D_{min}$ |
|---|---|---|---|---|---|---|
| 6a | 0.60 | 8.0 | excellent | excellent | 0.213 | 0.075 |
| 6b | 0.50 | 8.5 | excellent | excellent | 0.208 | 0.073 |
| 6c | 0.40 | 8.9 | excellent | excellent | 0.204 | 0.071 |
| 6d | 0.30 | 9.9 | excellent | excellent | 0.200 | 0.071 |
| 6e | 0.20 | 12.0 | excellent | excellent | 0.200 | 0.071 |
| C-6a | 0.60 | 9.3 | excellent | excellent | 0.220 | 0.075 |
| C-6b | 0.50 | 9.5 | excellent | excellent | 0.215 | 0.073 |
| C-6c | 0.40 | 9.8 | excellent | excellent | 0.211 | 0.072 |
| C-6d | 0.30 | 11.o | excellent | excellent | 0.209 | 0.071 |
| C-6e | 0.20 | >12.0 | excellent | excellent | 0.204 | 0.071 |

EXAMPLE 7

Backings packages were prepared in a manner similar to Example 2 except that a polyesterionomer latex available commercially from Eastman Chemicals under the trade name AQ55D was substituted for the polyurethane binder in the antistatic layer. The weight ratio of acicular conductive tin oxide to binder was varied from 70/30 to 95/5. The antistatic layers were applied to give a nominally constant total dry coverage of 0.55 g/m$^2$. Table 6 compares WER values, adhesion results, ultraviolet and optical densities for the complete backings packages containing the acicular conductive tin oxide of this invention with those containing granular tin oxide of Comparative Example 7 with the same polyesterionomer binder. In order to obtain a WER value equivalent to that of the present invention for a weight ratio of conductive acicular tin oxide to binder of 85/15 it is necessary to use a weight ratio of 90/10 for the granular conductive tin oxide. However, as is shown in Table 6, at the required higher weight ratio for the granular conductive tin oxide there is poor adhesion of the backings package. Furthermore, it is demonstrated that antistatic layers containing acicular tin oxide of the present invention have excellent adhesion results for higher tin oxide/binder ratios than can be achieved using granular tin oxide of the prior art. The present example further demonstrates that depending on the antistatic performance required for a specific application, the acicular conductive tin oxide can be dispersed in various polymeric binders and exhibit excellent adhesion and antistatic properties. However, such binders may not be suitable for use with granular conductive particles due to inadequate adhesion of the backings package at the higher weight ratios of conductive particles to binder in the antistatic layer needed to obtain the desired internal resistivity for the backings package.

TABLE 6

| Example | $SnO_2$/AQ55D | WER log ohm/square | Dry Adhesion | Wet Adhesion | Δ UV $D_{min}$ | Δ ortho $D_{min}$ |
|---|---|---|---|---|---|---|
| 7a | 70/30 | 8.1 | excellent | excellent | 0.258 | 0.089 |
| 7b | 75/25 | 7.8 | excellent | excellent | 0.256 | 0.089 |
| 7c | 80/20 | 8.4 | excellent | excellent | 0.257 | 0.089 |
| 7d | 85/15 | 7.3 | excellent | excellent | 0.257 | 0.087 |
| 7e | 90/10 | 6.8 | excellent | excellent | 0.259 | 0.090 |
| 7f | 95/5 | 6.2 | excellent | excellent | 0.258 | 0.088 |
| C-7a | 70/30 | 10.9 | excellent | excellent | 0.249 | 0.092 |
| C-7b | 75/25 | 9.6 | excellent | excellent | 0.248 | 0.090 |
| C-7c | 80/20 | 9.3 | excellent | excellent | 0.251 | 0.091 |
| C-7d | 85/15 | 8.6 | excellent | excellent | 0.247 | 0.089 |
| C-7e | 90/10 | 7.3 | fair | poor | 0.251 | 0.089 |
| C-7f | 95/5 | 6.9 | poor | fair | 0.247 | 0.086 |

EXAMPLE 8

Antistatic backings packages were prepared in a manner similar to Example 2 except that the polyurethane binder used in the antistatic layer was replaced by gelatin. The weight ratio of acicular conductive tin oxide to binder was 70/30. Additionally, the antistatic layers contained about 3.5 weight percent (based on gelatin) of 2,3-dihydroxy-1,4-dioxane as a hardener. The surface electrical resistivity was measured for the antistatic layers prior to overcoating with a transparent magnetic recording layer. After overcoating, WER values, adhesion results, net optical and ultraviolet densities were measured in the usual manner (given in Table 7).

COMPARATIVE EXAMPLE 8

Comparative Example 8 was prepared in a similar manner to Example 8 except that granular conductive tin oxide particles were used in place of the acicular tin oxide of the present invention.

TABLE 7

| Example | Total Dry Coverage g/m² | SER log ohm/square | WER log ohm/square | Dry Adhesion | Wet Adhesion | Δ UV $D_{min}$ | Δ ortho $D_{min}$ |
|---|---|---|---|---|---|---|---|
| 8a | 0.60 | 5.4 | 5.7 | excellent | excellent | 0.159 | 0.064 |
| 8b | 0.50 | 5.6 | 5.8 | excellent | excellent | 0.159 | 0.062 |
| 8c | 0.40 | 5.9 | 6.1 | excellent | excellent | 0.157 | 0.062 |
| 8d | 0.30 | 6.4 | 6.7 | excellent | excellent | 0.157 | 0.062 |
| 8e | 0.20 | 7.3 | 7.6 | fair | excellent | 0.149 | 0.060 |
| C-8a | 0.60 | 8.5 | 9.6 | poor | excellent | 0.152 | 0.065 |
| C-8b | 0.50 | 8.2 | 9.8 | poor | excellent | o.154 | 0.064 |
| C-8c | 0.40 | 8.4 | 9.9 | poor | excellent | 0.153 | 0.063 |
| C-8d | 0.30 | 8.6 | 10.2 | poor | excellent | 0.146 | 0.062 |
| C-8e | 0.20 | 9.1 | 10.3 | very poor | excellent | 0.147 | 0.062 |

Example 8 demonstrates that gelatin-based antistatic layers comprised of acicular conductive tin oxide particles have significantly better SER and WER values than those of Comparative Example 8 which contained conductive granular tin oxide when used in a backings package containing a transparent magnetic recording layer. Furthermore, after overcoating with a solvent formulated magnetic recording layer, the backings packages of the present invention undergo significantly less conductivity loss as evidenced by lower WER values than backings packages of the prior art. In addition, for the same weight ratio of tin oxide/gelatin used in Example 8, the backing packages comprising acicular conductive tin oxide have superior dry adhesion results compared to Comparative Example 8.

EXAMPLE 9

A backings package was prepared in a manner similar to Example 7d except that the cellulose diacetate and cellulose triacetate binder system of the transparent magnetic recording layer was substituted by a polyurethane binder as taught in U.S. Pat. No. 5,451,495. The resulting backings package exhibited excellent dry and wet adhesion and a WER value of 6.7. Thus, the antistatic layer containing acicular conductive tin oxide particles of the present invention can be used with a variety of transparent magnetic recording layers to produce highly adherent, transparent backings packages which also exhibit excellent antistatic properties.

EXAMPLE 10

Backings packages were prepared by applying a transparent magnetic recording layer as in Example 1 onto a primed polyethylene naphthalate support. Antistatic coating formulations of acicular conductive tin oxide particles dispersed with gelatin at weight ratios of 70/30 (Example 9a) and 50/50 (Example 9b) tin oxide/gelatin were subsequently coated on top of the transparent magnetic recording layer to give a nominal total dry coverage of 0.40 g/m². The antistatic coating formulations also included nominally 3.5 weight percent (based on gelatin) of 2,3-dihydroxy-1, 4-dioxane as a hardener. The SER values, net ultraviolet and optical densities and dry adhesion results for the resulting backings packages are given in Table 8. These examples demonstrate that an antistatic layer containing acicular conductive tin oxide particles of this invention also can be applied over a transparent magnetic recording layer and exhibit excellent performance.

TABLE 8

| Example | $SnO_2$/ gelatin | SER log ohm/square | dry adhesion | Δ UV $D_{min}$ | Δ ortho $D_{min}$ |
|---|---|---|---|---|---|
| 9a | 70/30 | 8.6 | good | 0.195 | 0.069 |
| 9b | 50/50 | 10.8 | good | 0.181 | 0.067 |

While there has been shown and described what are presently considered to be the preferred embodiments of the invention, various modifications and alterations will be obvious to those skilled in the art. All such modifications and alterations are intended to fall within the scope of the appended claims.

What is claimed is:

1. An imaging element for use in an image-forming process; said imaging element comprising a support, an image-forming layer, a transparent magnetic recording layer, and an electrically-conductive layer; said electrically-conductive layer comprising a dispersion in a film-forming binder of acicular, crystalline single-phase, conductive metal-containing particles, said particles having a cross-sectional diameter less than or equal to 0.02 μm and an aspect ratio greater than or equal to 5:1; said transparent magnetic recording layer comprising a dispersion in a film-forming binder of ferromagnetic particles.

2. The imaging element of claim 1, wherein the acicular crystalline single phase conductive metal-containing particles comprise a 2 to 70 percent volume fraction of said electrically-conductive layer.

3. The imaging element of claim 1, wherein the acicular crystalline single-phase conductive metal-containing particles comprise a 5 to 50 percent volume fraction of said conductive layer.

4. The imaging element of claim 1, wherein the acicular crystalline single-phase conductive metal-containing particles comprise a 40 to 70 percent volume fraction of said conductive layer.

5. The imaging element of claim 1, wherein said acicular conductive metal-containing particles comprise a dry weight coverage of from 5 to 1000 mg/m².

6. The imaging element of claim 1, wherein said acicular conductive metal-containing particles comprise a dry weight coverage of from 10 to 500 mg/m².

7. The imaging element of claim 1, wherein said electrically-conductive layer has a surface resistivity of less than $1\times10^{10}$ ohms per square.

8. The imaging element of claim 1, wherein said electrically-conductive layer has a surface resistivity of less than $1\times10^{8}$ ohms per square.

9. The imaging element of claim 1, wherein the acicular, crystalline single-phase, metal-containing particles exhibit a packed powder resistivity of $10^3$ ohm-cm or less.

10. The imaging element of claim 1, wherein said support comprises a cellulose acetate film.

11. The imaging element of claim 1, wherein the acicular, crystalline single-phase, metal-containing particles are less than 0.02 μm in cross-sectional diameter and less than 0.5 μm in length.

12. The imaging element of claim 1, wherein the acicular, crystalline single-phase, metal-containing particles are less than 0.01 μm in cross-sectional diameter and less than 0.15 μm in length.

13. The imaging element of claim 1, wherein the acicular, crystalline single-phase, metal-containing particles comprise acicular metal oxide particles.

14. The imaging element of claim 1, wherein the acicular, crystalline single-phase, metal-containing particles are acicular doped metal oxides.

15. The imaging element of claim 1, wherein the acicular, crystalline single-phase, metal-containing particles are acicular metal oxides containing oxygen deficiencies.

16. The imaging element of claim 1, wherein the acicular, crystalline single-phase, metal-containing particles comprise acicular doped tin oxide particles.

17. The imaging element of claim 1, wherein the acicular, crystalline single-phase, metal-containing particles comprise acicular antimony-doped tin oxide particles.

18. The imaging element of claim 1, wherein the acicular, crystalline single-phase, metal-containing particles comprise acicular niobium-doped titanium dioxide particles.

19. The imaging element of claim 1, wherein the acicular, crystalline single-phase, metal-containing particles comprise acicular tin-doped indium sesquioxide.

20. The imaging element of claim 1, wherein the acicular, crystalline single-phase, metal-containing particles are acicular metal nitrides, carbides, silicides or borides.

21. The imaging element of claim 1, wherein said film-forming binder of the electrically-conductive layer comprises a water-soluble polymer.

22. The imaging element of claim 1, wherein said film-forming binder of the electrically-conductive layer comprises gelatin.

23. The imaging element of claim 1, wherein said film-forming binder of the electrically-conductive layer comprises a cellulose derivative.

24. The imaging element of claim 1, wherein said film-forming binder of the electrically-conductive layer comprises a water-insoluble polymer.

25. The imaging element of claim 1, wherein said film-forming binder of the electrically-conductive layer comprises a water-dispersible polyesterionomer.

26. The imaging element of claim 1, wherein said film-forming binder of the electrically-conductive layer comprises a vinylidene chloride-based copolymer.

27. The imaging element of claim 1, wherein said film-forming binder of the electrically-conductive layer comprises a water-dispersible polyurethane.

28. The imaging element of claim 1, wherein said support comprises a poly(ethylene terephthalate) film or a poly (ethylene naphthalate) film.

29. The imaging element of claim 1, wherein the transparent magnetic recording layer comprises cobalt surface-modified $\gamma$-$Fe_2O_3$ or magnetite particles.

30. The imaging element of claim 29, wherein the cobalt surface-modified $\gamma$-$Fe_2O_3$ particles comprise a dry weight coverage of from 10 mg/m$^2$ to 1000 mg/m$^2$.

31. The imaging element of claim 29, wherein the cobalt surface-modified $\gamma$-$Fe_2O_3$ particles comprise a dry weight coverage of from 20 mg/m$^2$ to 70 mg/m$^2$.

32. The imaging element of claim 1, wherein said film-forming binder of the transparent magnetic recording layer comprises cellulose diacetate or cellulose triacetate.

33. The imaging element of claim 1, wherein said film-forming binder of the transparent magnetic recording layer comprises a polyurethane.

34. The imaging element of claim 1, wherein said support is surface-treated by means of corona discharge, glow discharge, UV exposure, electron beam treatment, flame treatment, solvent washing, adhesion promoting agents or is overcoated with primer or tie layers containing adhesion-promoting polymers.

35. A photographic film comprising:

(1) a support;

(2) a silver halide emulsion layer on one side of said support;

(3) a transparent magnetic recording layer on the opposite side of said support; said transparent magnetic recording layer comprising a dispersion of ferromagnetic particles in a film-forming polymeric binder;

(4) an electrically-conductive layer which serves as an antistatic backing layer underlying said transparent magnetic recording layer; said electrically-conductive layer comprising a dispersion in a film-forming binder of electrically-conductive, acicular, crystalline single-phase, antimony-doped tin oxide particles, said acicular tin oxide particles having a cross-sectional diameter less than or equal to 0.02 μm and an aspect ratio of greater than or equal to 5:1.

36. A photographic film comprising:

(1) a support;

(2) a silver halide emulsion layer on one side of said support;

(3) a transparent magnetic recording layer on the opposite side of said support; said transparent magnetic recording layer comprising ferromagnetic particles dispersed in a film-forming polymeric binder;

(4) an electrically-conductive layer which serves as an antistatic backing layer overlying said transparent magnetic recording layer; said electrically-conductive layer comprising a dispersion in a film-forming binder of electrically-conductive, acicular, crystalline single-phase, antimony-doped tin oxide particles, said acicular tin oxide particles having a cross-sectional diameter less than or equal to 0.02 μm and an aspect ratio of greater than or equal to 5:1.

37. A photographic film comprising:

(1) a support;

(2) a silver halide emulsion layer on one side of said support;

(3) a conductive transparent magnetic recording layer on the opposite side of said support; said conductive transparent magnetic recording layer comprising a dispersion in a film-forming binder of ferromagnetic particles and acicular, crystalline single-phase, antimony-doped tin oxide particles; said tin oxide particles having a cross-sectional diameter less than or equal to 0.02 μm and an aspect ratio of greater than or equal to 5:1.

* * * * *